US010364054B2

(12) United States Patent
Luo et al.

(10) Patent No.: US 10,364,054 B2
(45) Date of Patent: Jul. 30, 2019

(54) M-SHAPED FULLY AUTOMATIC WINDING MACHINE

(71) Applicant: HANGZHOU YOUNGSUN INTELLIGENT EQUIPMENT CO., LTD., Xihu Hangzhou, Zhejiang (CN)

(72) Inventors: Bangyi Luo, Zhejiang (CN); Ziquan Zhang, Zhejiang (CN); Caiqin Zhang, Zhejiang (CN)

(73) Assignee: HANGZHOU YOUNGSUN INTELLIGENT EQUIPMENT CO., LTD., Hangzhou, Zhejiang Province (CN)

( * ) Notice: Subject to any disclaimer, the term of this patent is extended or adjusted under 35 U.S.C. 154(b) by 321 days.

(21) Appl. No.: 15/511,378

(22) PCT Filed: Dec. 5, 2014

(86) PCT No.: PCT/CN2014/093180
§ 371 (c)(1),
(2) Date: Mar. 15, 2017

(87) PCT Pub. No.: WO2016/045197
PCT Pub. Date: Mar. 31, 2016

(65) Prior Publication Data

US 2017/0361955 A1 Dec. 21, 2017

(30) Foreign Application Priority Data

Sep. 22, 2014 (CN) ..... 2014 1 0487307
Sep. 22, 2014 (CN) ..... 2014 2 0546401 U
Sep. 22, 2014 (CN) ..... 2014 2 0547021 U

(51) Int. Cl.
*B65B 11/04* (2006.01)
*B65B 11/06* (2006.01)
(Continued)

(52) U.S. Cl.
CPC ..... *B65B 11/045* (2013.01); *B65B 11/04* (2013.01); *B65B 11/06* (2013.01); *B65B 61/04* (2013.01);
(Continued)

(58) Field of Classification Search
CPC ..... B65B 11/04; B65B 11/045; B65B 61/06
See application file for complete search history.

(56) References Cited

U.S. PATENT DOCUMENTS 4,578,923 A * 4/1986 Petterson ..... B65B 11/045 414/754
4,753,173 A * 6/1988 James ..... B60S 13/02 104/35
(Continued)

FOREIGN PATENT DOCUMENTS

CN 202320826 U * 7/2012 ..... B65B 11/02
CN 203199262 U 9/2013
(Continued)

*Primary Examiner* — Alexander M Valvis
*Assistant Examiner* — Mobeen Ahmed
(74) *Attorney, Agent, or Firm* — Muncy, Geissler, Olds & Lowe, P.C.

(57) ABSTRACT

Disclosed is an M-shaped fully automatic winding machine provided with a main controller, a film clamping device, an automatic film cutting device, and a film lifting device. The film clamping device is provided on an M-shaped turntable, is driven to work by a second electric motor and uses a storage battery as a power source. A secondary controller controlling the second electric motor to work is also provided on the M-shaped turntable, is in a communication connection with the main controller via wireless data and is controlled by the main controller. A film clamping working position of the film clamping device is in front of an upright post when the M-shaped turntable turns to the angle of the original position. The M-shaped winding machine is also provided with a storage battery charging connection device.
(Continued)

When the M-shaped turntable turns to the angle of a charging position, a turntable upper part and a turntable outer part of the charging connection device can be electrically connected. A driving electric motor of a film frame lifting device, the driving electric motor of the M-shaped turntable, and the power devices in the automatic film cutting device and the film lifting device are controlled by the main controller. The M-shaped winding machine can realize automatic film clamping and fully automatic film winding.

4 Claims, 11 Drawing Sheets

(51) Int. Cl.
*B65B 61/04* (2006.01)
*B65B 61/06* (2006.01)
*B65B 65/02* (2006.01)

(52) U.S. Cl.
CPC ..... *B65B 61/06* (2013.01); *B65B 65/02* (2013.01); *B65B 2210/14* (2013.01)

(56) References Cited

U.S. PATENT DOCUMENTS 5,365,723 A * 11/1994 Ramos ..... B65B 11/045 53/211
6,370,839 B1 * 4/2002 Nakagawa ..... B65B 11/008 52/211
6,530,550 B1 * 3/2003 Knighton ..... G01B 5/0004 104/35
8,413,407 B2 * 4/2013 Barsacchi ..... B25J 15/0616 242/525
8,641,027 B2 * 2/2014 Koskela ..... B65B 11/045 104/44
2003/0140599 A1 7/2003 Forrest
2005/0016135 A1 * 1/2005 Heikaus ..... B65B 11/025 53/588
2006/0219125 A1 * 10/2006 Yatsko ..... B60S 13/02 104/44
2009/0178374 A1 * 7/2009 Lancaster, III ..... B65B 11/025 53/441
2010/0058711 A1 * 3/2010 Blumenstock ..... B65B 7/285 53/64
2012/0079929 A1 * 4/2012 Ciou ..... B26D 5/16 83/375
2016/0200467 A1 * 7/2016 Cousins ..... B65B 11/025 53/556

FOREIGN PATENT DOCUMENTS

CN 203306297 U 11/2013
CN 103708049 A 4/2014
EP 0178145 A1 4/1986
GB 2113645 A * 8/1983 ..... B65B 11/045

* cited by examiner

M-SHAPED FULLY AUTOMATIC WINDING MACHINE

FIELD OF THE INVENTION

The present invention relates to an M-shaped winding machine.

BACKGROUND

Winding machines are a kind of mechanical equipments in the field of packaging machinery. It is used to wrap packaging films on the surface of articles, including a turntable. Articles are placed on the turntable to rotate with it, and thus the packaging films are wrapped on its surface.

M-shaped winding machine is a special winding machine, with M-shaped groove in the turntable, so that the form arms of hydraulic truck can enter the groove when conveying articles. M-shaped turntable is always unable to solve the problem of mechanized film wrapping, and it is unable to achieve film clamping on the M-shaped turntable by equipped with mechanical device, to automatically control the film clamping process and enhance working efficiency.

SUMMARY

A technical problem to be solved in the invention is to provide an M-shaped winding machine capable of automatic film clamping, to provide prerequisite for fully automatic film winding. To this end, the present invention adopts the following technical solutions:

An M-shaped winding machine, provided with a base, a rotatable M-shaped turntable and an upright post, the upright post is provided with a film frame lifting device which is driven to work by a first electric motor, the film frame is at one side of the upright post; wherein, The M-shaped winding machine is provided with a main controller;

The M-shaped winding machine is further provided with a film clamping device. The film clamping device is provided on an M-shaped turntable, is driven to work by a second electric motor and uses a storage battery as a power source; A secondary controller controlling the second electric motor to work is also provided on the M-shaped turntable, is in a communication connection with the main controller via wireless data and is controlled by the main controller;

A film clamping working position of the film clamping device is in front of an upright post when the M-shaped turntable turns to the angle of the original position;

The M-shaped winding machine is also provided with a storage battery charging connection device including a turntable upper part and a turntable outer part. The turntable upper part is mounted on the M-shaped turntable and the M-shaped turntable is mounted on the base next to the M-shaped turntable. When the M-shaped turntable turns to the angle of a charging position, the turntable upper part and the turntable outer part of the charging connection device can be electrically connected. The turntable outer part is connected with the power source, and the turntable upper part transmits electricity to the storage battery for charging;

A first driving electric motor and a driving electric motor of the M-shaped turntable are also connected with the main controller, and controlled by the main controller.

On the basis of above technical solutions, the prevent invention further employs the following technical solutions:

The turntable outer part is provided with a driving cylinder and a connecting contact. The driving cylinder drives the connecting contact to move front and back toward to the contact member of the turntable upper part, and the working of driving cylinder is controlled by the main controller.

The M-shaped winding machine is provided with a film lifting device, which is disposed at the base in front of the film clamping device. The film lifting device is provided with a film lifting member that can be lifted up and down, the film lifting member is lifted up and down in the space between the lifting film frame the M-shaped turntable; the driving electric motor or cylinder that drives the film lifting member to lift up and down is controlled by the main controller; the M-shaped winding machine is provided with an automatic film cutting device which is disposed at the base in front of the film clamping device, the power device in the automatic film cutting device is controlled by the main controller.

The upright post is on the side at the back of the base, which is in the same direction as the side where the film frame is on the upright post; a movable mounting plate is provided at the back of the base, and the movable mounting plate can mounted on the base transversely through fasteners. The automatic film cutting device is mounted on the movable mounting plate which forms a notch shape, and the upright post is located at the notch.

With the technical solutions, the present invention has innovatively realized the establishment of film clamping device and permanent automatic power supply and the control on the M-shaped turntable, paving the way for the automatic mechanization of M-shaped winding machine; further, the invention has realized M-shaped turntable rotation, film frame lifting, film clamping, automatic supply of power and film lifting on the M-shaped turntable and the fully automatic mechanized operations of film cutting, and realized convenient removal and installation of film lifting device and automatic film cutting device, so that the upright post can be turned down to save the space for transport.

DETAILED DESCRIPTION

Figure 1:
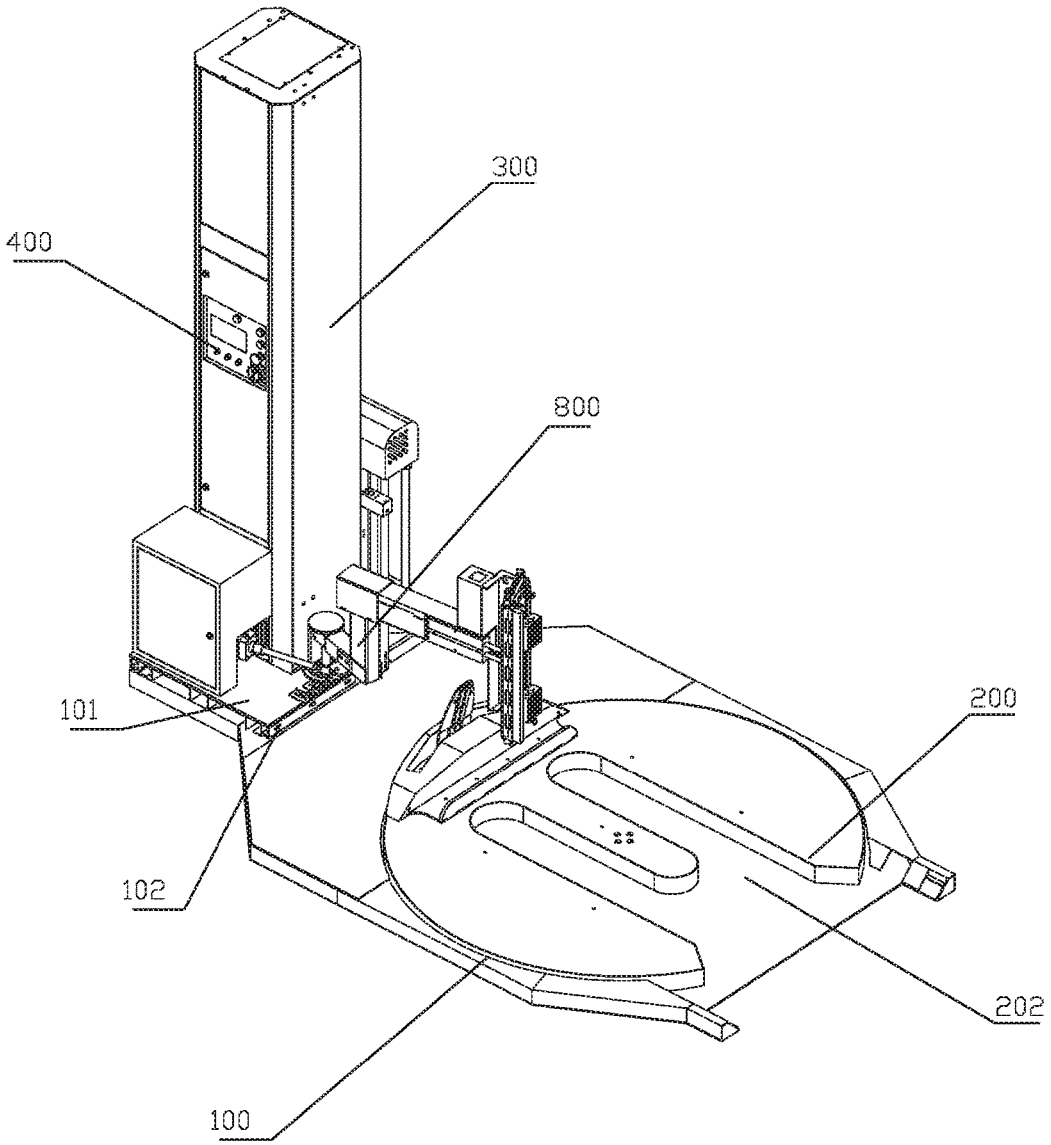
FIG. 1 is a schematic diagram according to an embodiment of the present invention.
Figure 1A:
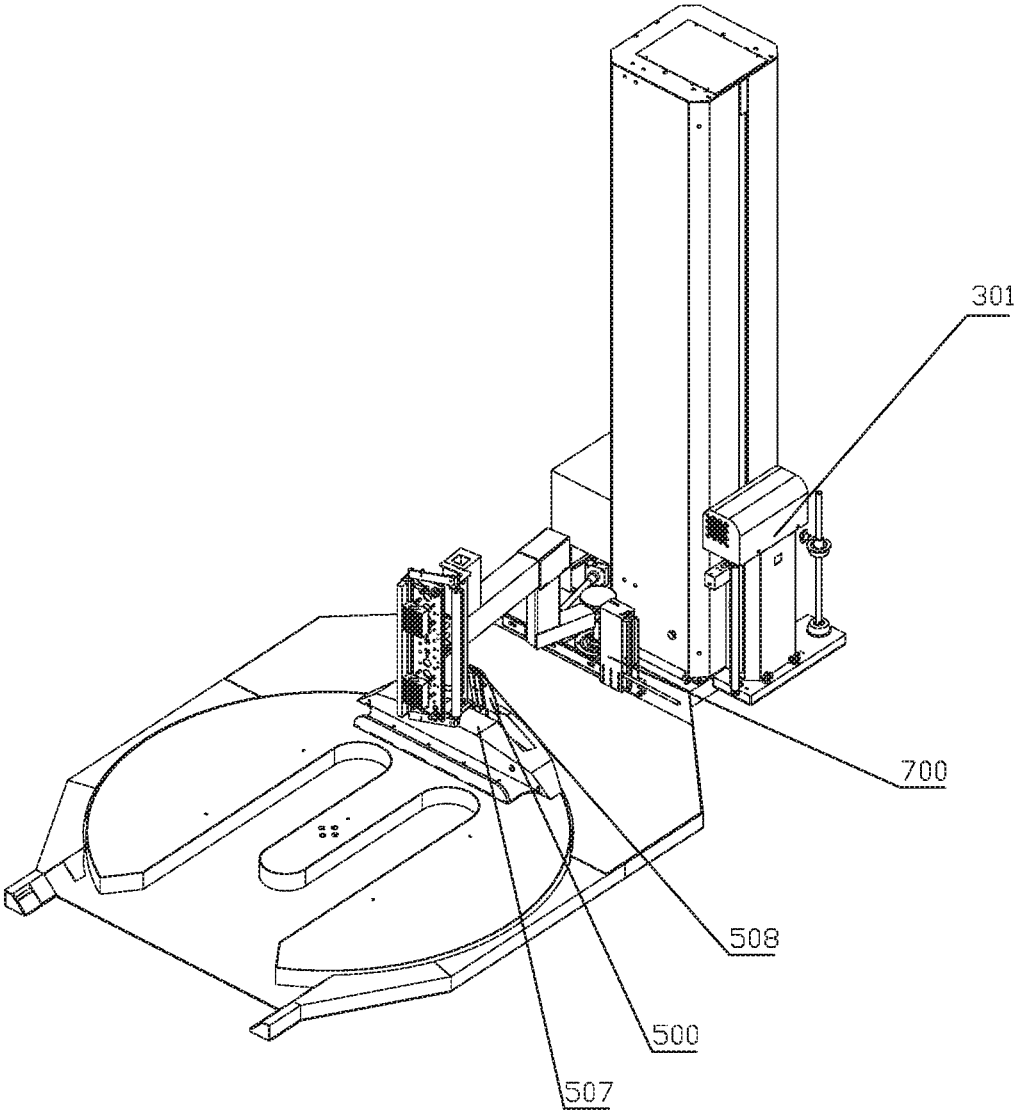
FIG. 1*a* is a schematic view according to an embodiment of the present invention from another perspective.
Figure 1B:
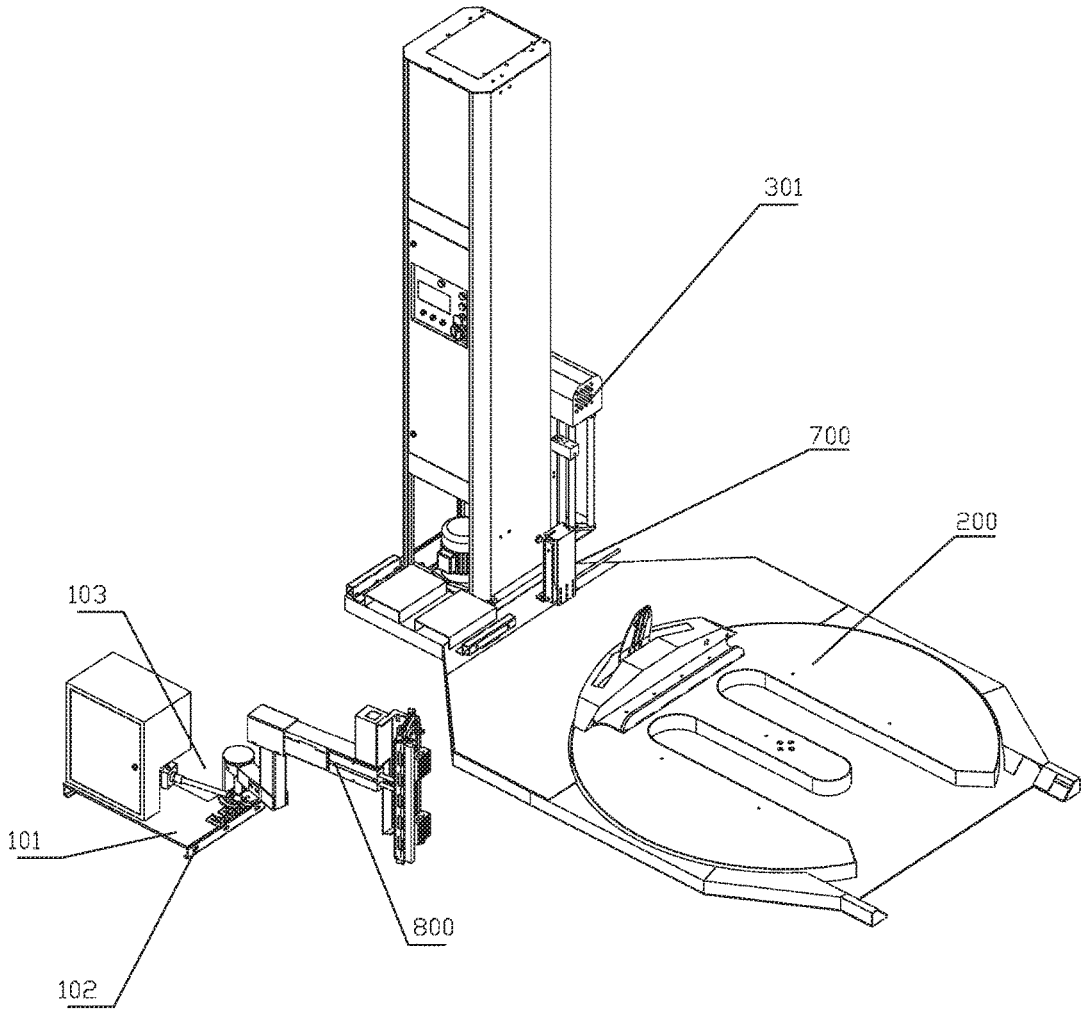
FIG. 1*b* is an exploded view according to an embodiment of the present invention.

Referring to the figures, an M-shaped fully automatic winding machine is provided with a base 100, a rotatable M-shaped turntable 200 and an upright post 300. A film frame lifting device is provided in the upright post and is driven by a first electric motor. Its lifting transmission mechanism can adopt chains, synchronous belt, etc. The film frame 301 is connected to a lifting transmission device.

The M-shaped winding machine is provided with a main controller, for example, when a computer is used, the reference number 400 is its operation panel, the main controller is provided on the M-shaped winding machine part beyond M-shaped turntable 200, for instance, provided in an upright post, or in a separate operating console. The main controller is provided with a wireless communication device which can realize wire data communications with the wireless communication device on the M-shaped turntable.

The M-shaped winding machine is provided with a film clamping device 500, which is provided on an M-shaped turntable 200 and driven to work by a second electric motor 501 and uses a storage battery 502 as a power source. A secondary controller 201 controlling the second electric motor 501 to work is also provided on the M-shaped turntable 200, is in a communication connection with the main controller via wireless data and is controlled by the main controller.

The secondary controller may be a controller with an arithmetic function or only a switch of a second electric motor 501 capable of wireless data communication controlled by the main controller.

Figure 2B:
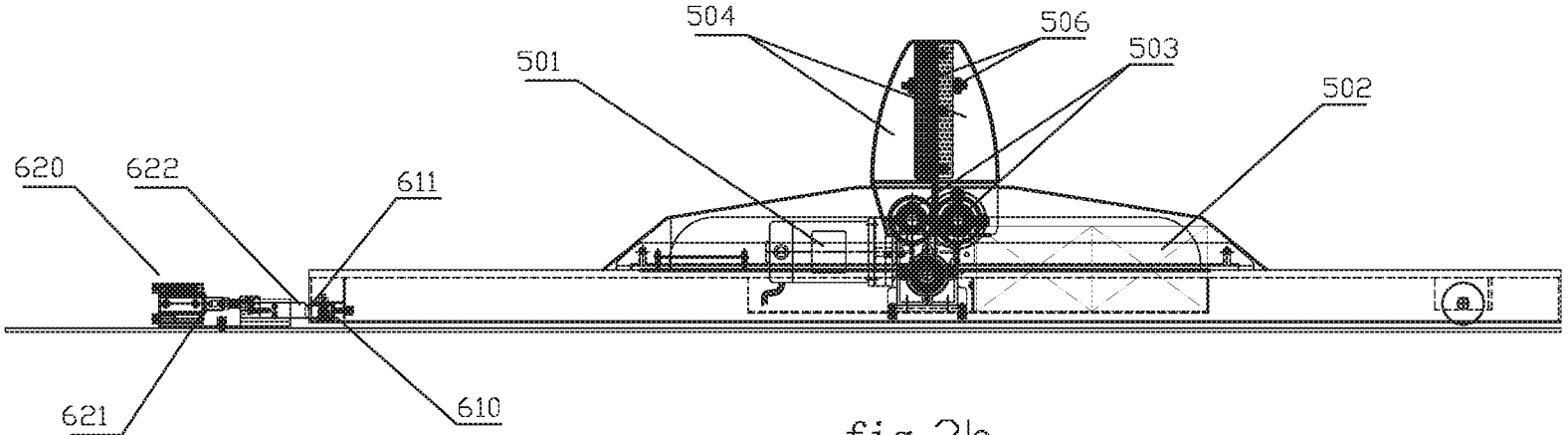
FIG. 2*b* is a schematic diagram of a storage battery charging connection device under the charging state according to an embodiment of the present invention.
Figure 2A:
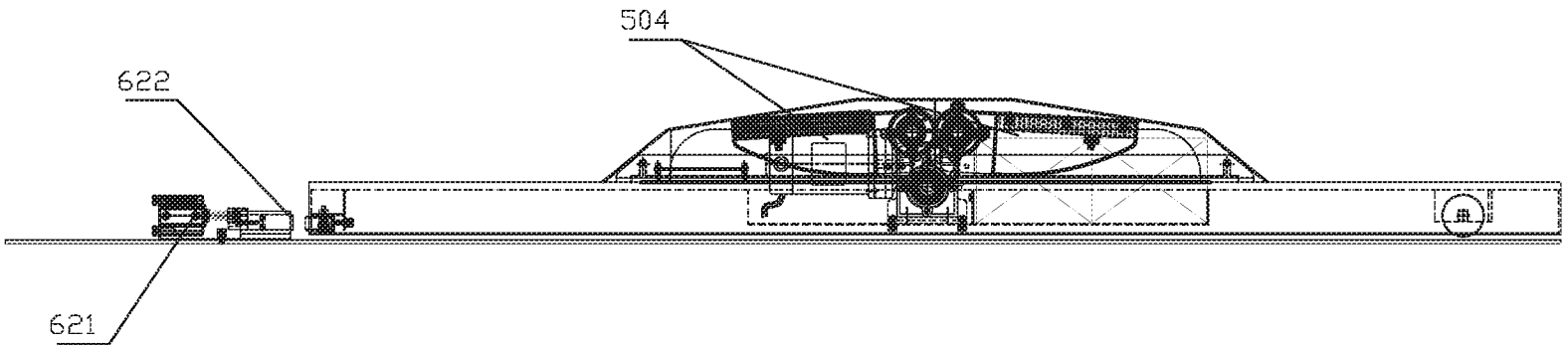
FIG. 2*a* is schematic diagram of a storage battery charging connection device under a release state according to an embodiment of the present invention.

The film clamping device consists of two clamping arms 504, the second electric motor 501 drives the two clamping arms 504 to clamp (FIG. 2*b*) and release the film (FIG. 2*a*) by the gear 503.

The aforesaid film can be a combination of flexible films, for example, two clamping arms or at least one of them are provided with a flexible film clamping strip 505 at the film part. The flexible film clamping strip has a transverse adjusting groove, to adjust the position of flexible film clamping strip transversely, adjust the degree of clamping. A limit screw 506 of flexible film clamping strip 505 is provided on the clamping arm 504 at the rear side of the flexible film clamping strip 505.

In order to improve the quality of film winding, a first transition surface 511 between the left and right sides of housing and the M-shaped turntable 200 and a second transition surface 512 between the housing top 510 and the first transition surface 511 at the left and right sides of the housing are provided at the left and right sides on the top of the housing 507 of the film clamping device. In this way, even if wound around the cover, the film can be withdrawn along the second transition surface, which will not be hung on the cover nor be broken, so that the films can be wound at a lower part of the bottom of the article by the winding machine, significantly improving the winding quality.

The first transition surface 511 and the second transition surface 512, which are on the left side, are tilted downwardly when extending toward the left, and the first transition surface 511 and the second transition surface 512, which are on the right side, are tilted downwardly when extending toward the right.

In order to further improve the anti-hanging effect of housing, the top-view shape of the housing can be designed similar to "willow-leaf shape", that is, the first transition surface 511 and the second transition surface 512 on the left right become narrowed when extending to the left, and the first transition surface 511 and the second transition surface 512 on the right side narrowed when extending to the right.

Further, the width of the first transition surface 511 on the left side is gradually reduced to form a tip when extending to the left, and the width of the first transition surface 511 on the right side is gradually reduced to form a tip when extending to the right; or, if necessary, one of the first transition surfaces 511 on the left side and on the right side forms a tip.

Further, the ends of the first transition surface 511 on the left and right sides of the housing extend beyond the left and right ends of the baffle plate 520 at the front of the housing, respectively.

The two clamping arms 504 extend out of the housing 507 in the groove 513 at the top of the housing.

The housing with such a shape can just cover the second electric motor 501, gear 503, storage battery 502, remote controller 201 inside, wherein, the storage battery and electric motor are located on both sides of the gear 503 and two clamping arms 504 respectively.

The M-shaped turntable need to reset to zero at the end of each winding operation, that is, at the angle of the original position, at this time, the M top of M-shaped groove 202 of M-shaped turntable faces towards the upright post (as shown in FIG. 1), the position of the film clamping device should be such that the film clamping working position (that is, the clamping port 508 when the clamping arm 504 (or flexible film clamping strip 505) clamps the film) is in front of the upright post 300, and the top of the M-shaped groove on the M-shaped turntable is facing the film clamping working position.

Figure 3:
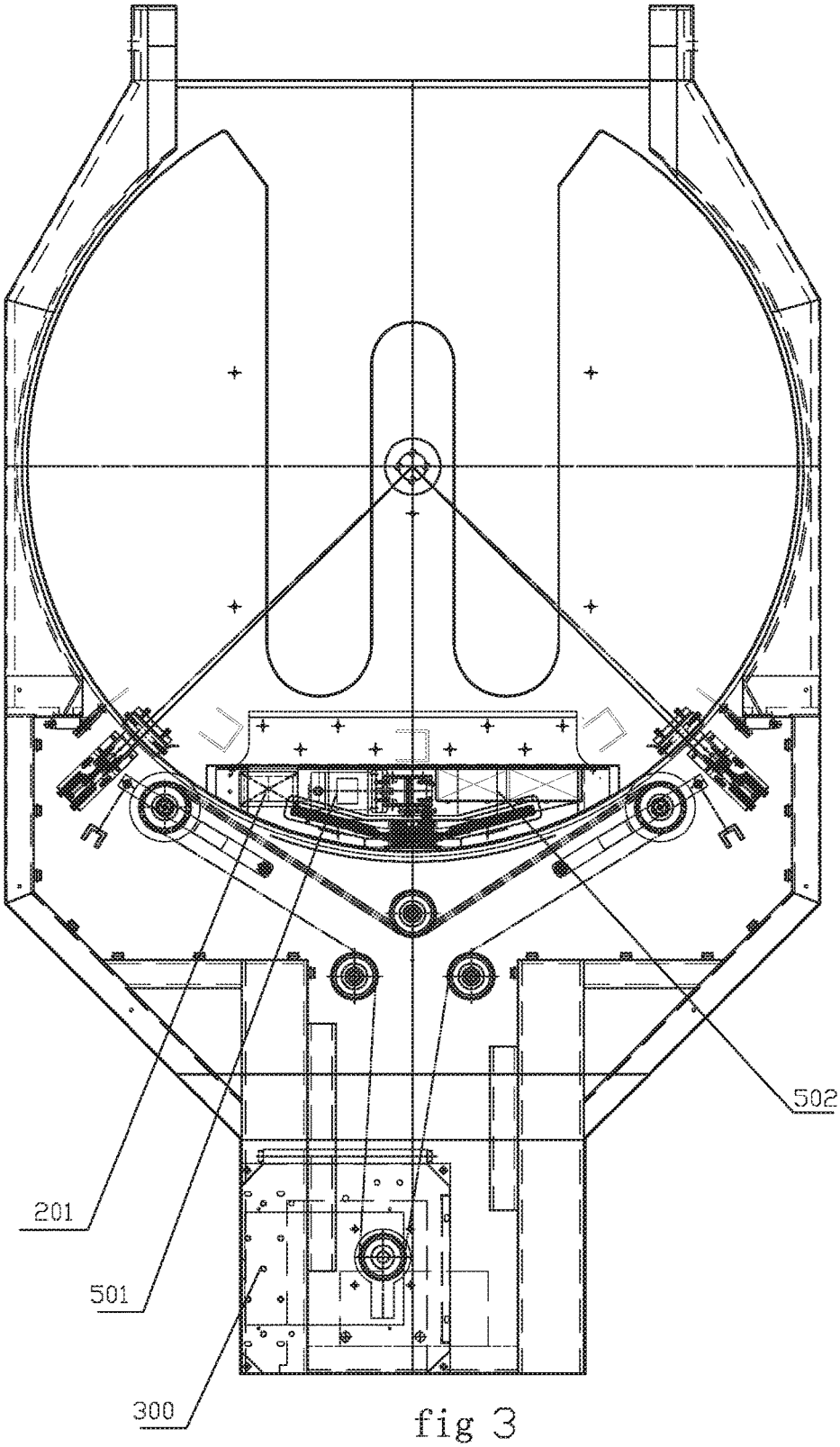
FIG. 3 is a top view according to an embodiment of the present invention.
Figure 4:
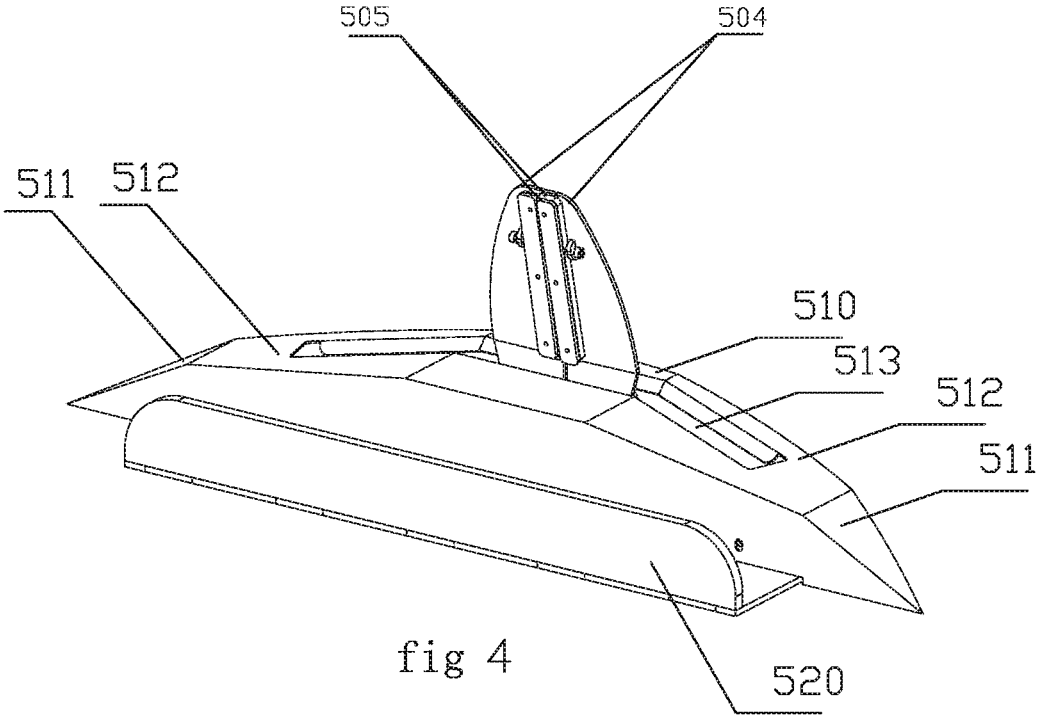
FIG. 4 is a schematic view showing the outline of a film clamping device according to an embodiment of the present invention.
Figure 5:
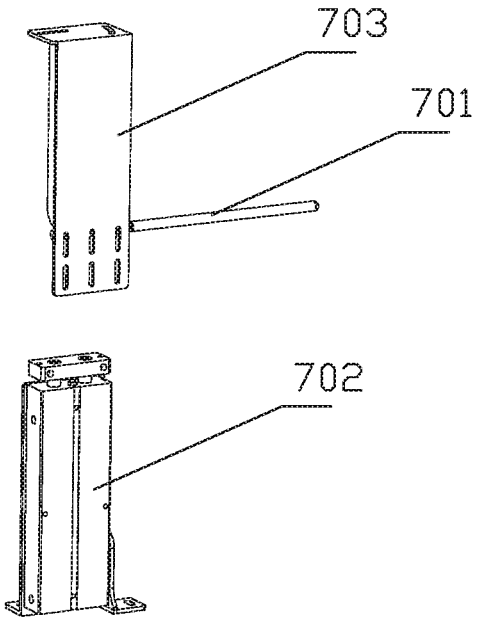
FIG. 5 is an exploded view of a film lifting device according to an embodiment of the present invention.
Figure 6:
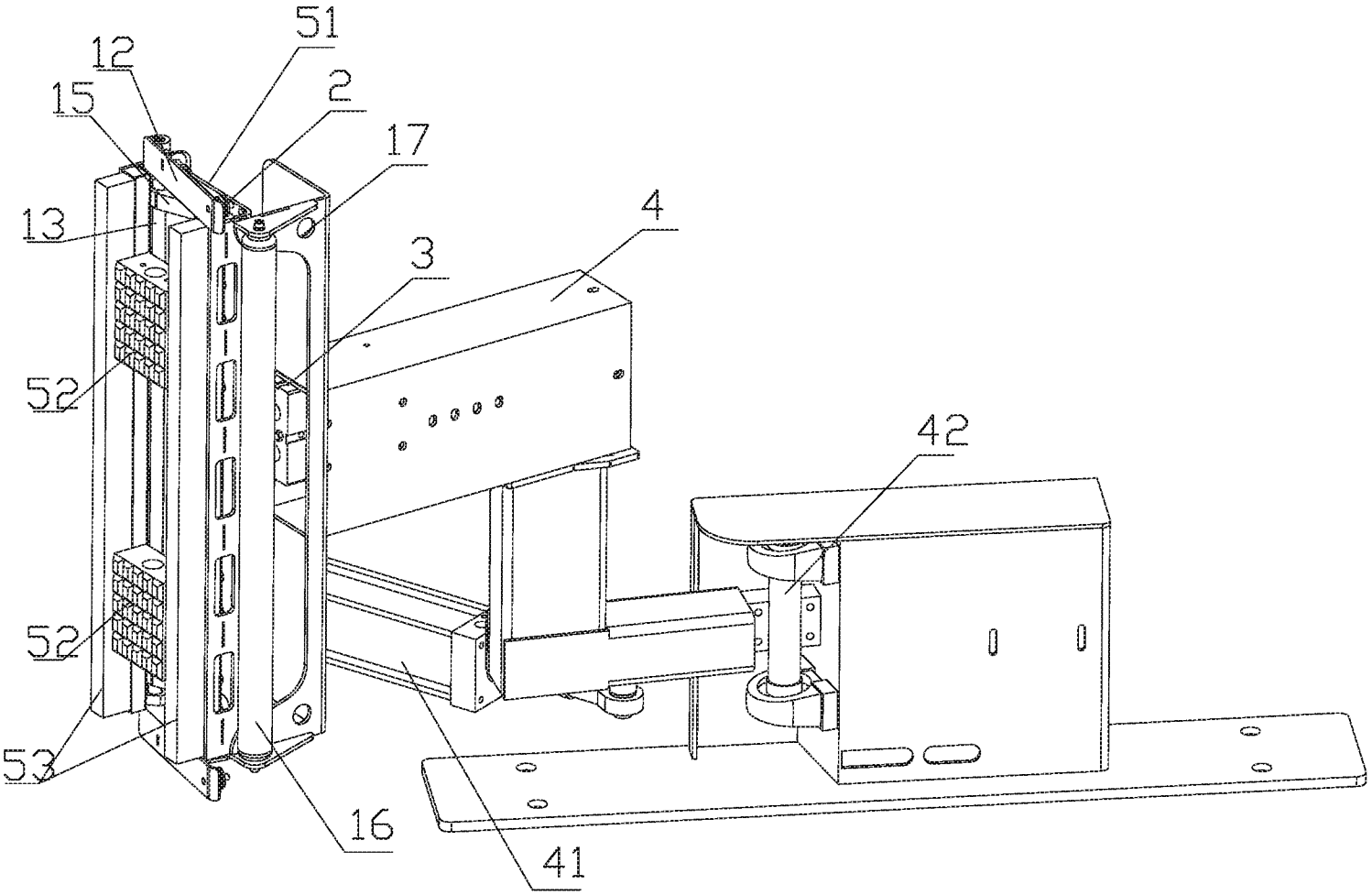
FIG. 6 is a schematic diagram of an automatic film cutting device according to an embodiment of the present invention.
Figure 7:
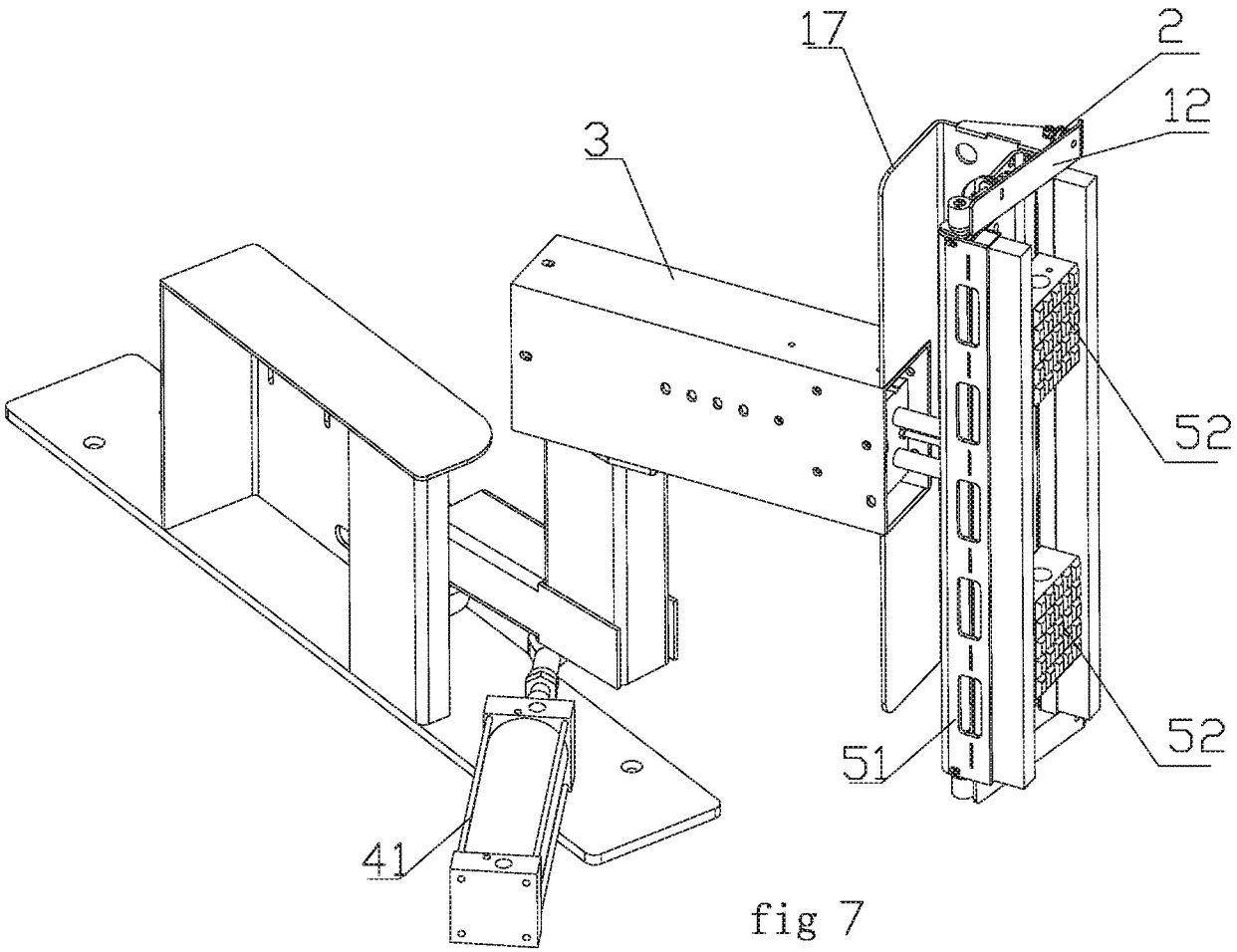
FIG. 7 is a schematic diagram of an automatic film cutting device in another direction according to an embodiment of the present invention.
Figure 9:
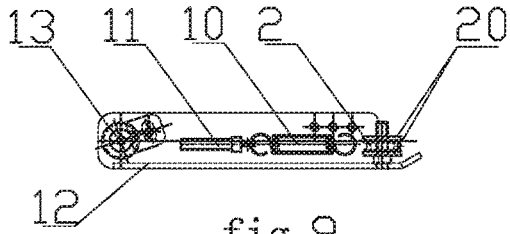
FIG. 9 is a bottom view of a connection structure of a film cutting component in FIG. 8.
Figure 8:
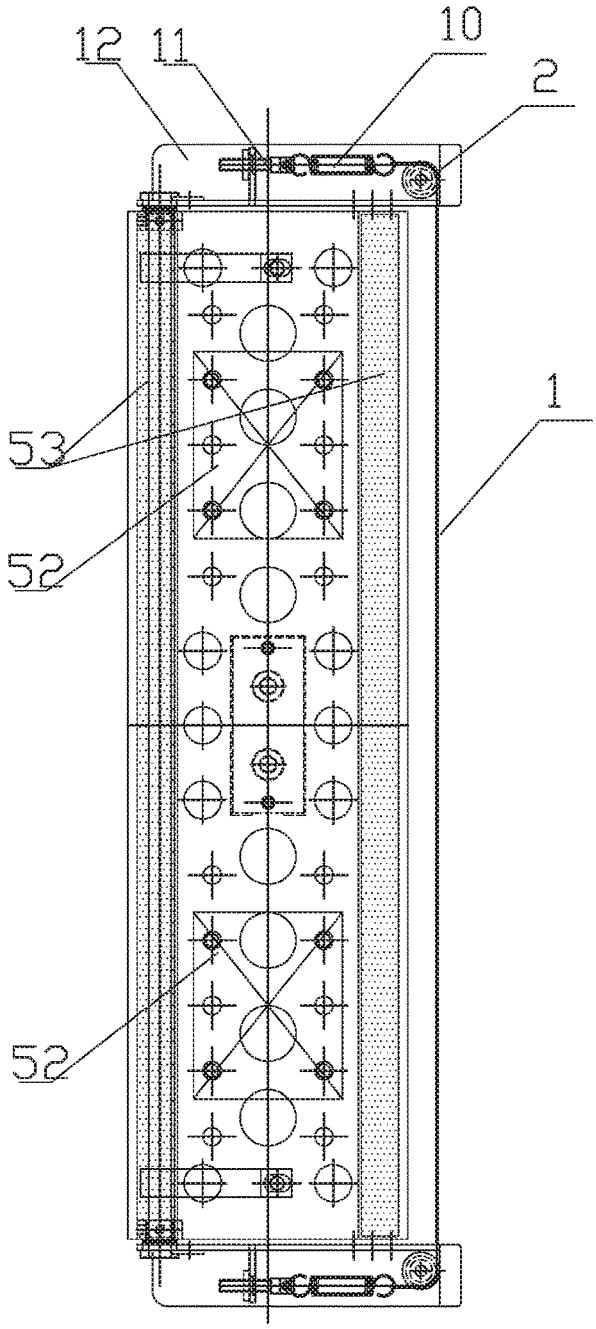
FIG. 8 is a front view of a hot sticking mechanism of an automatic film cutting device according to an embodiment of the present invention.
Figure 10:
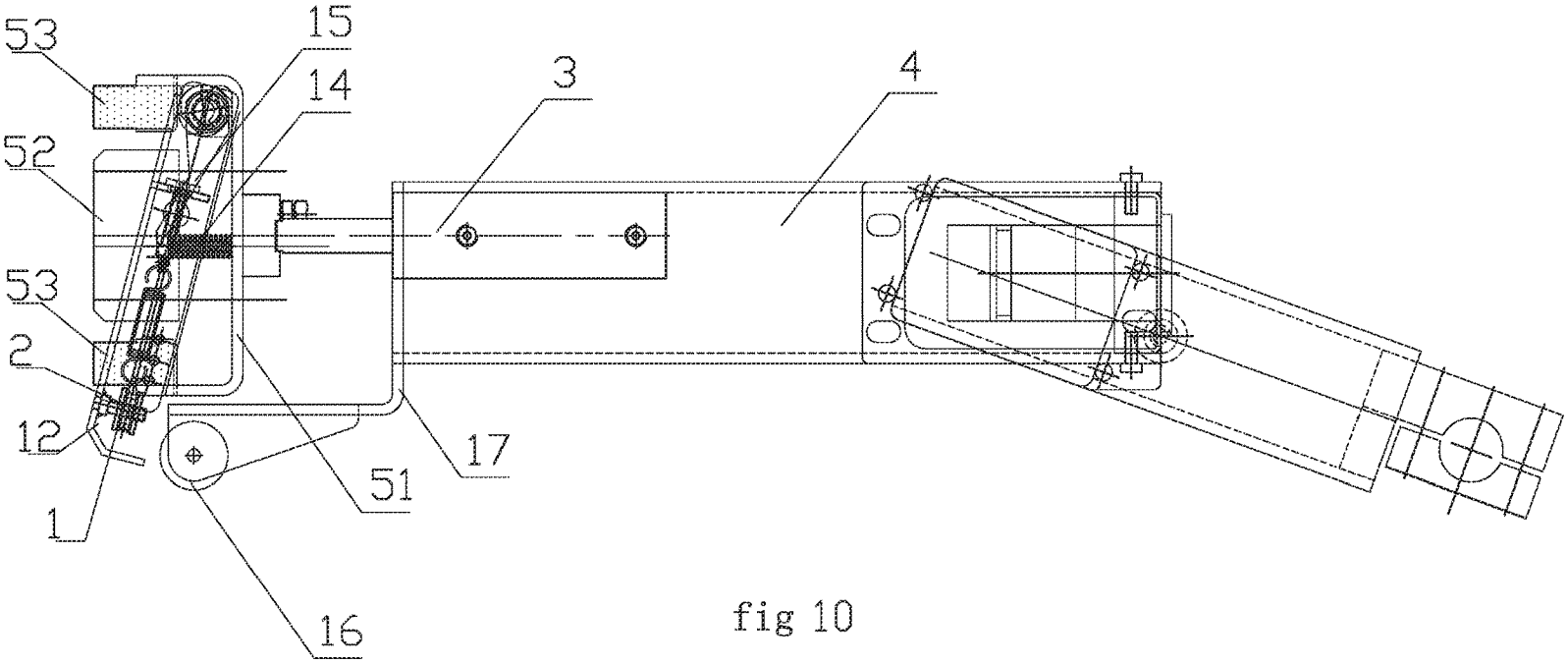
FIG. 10 is a top view of an automatic film cutting device according to an embodiment of the present invention.
Figure 11:
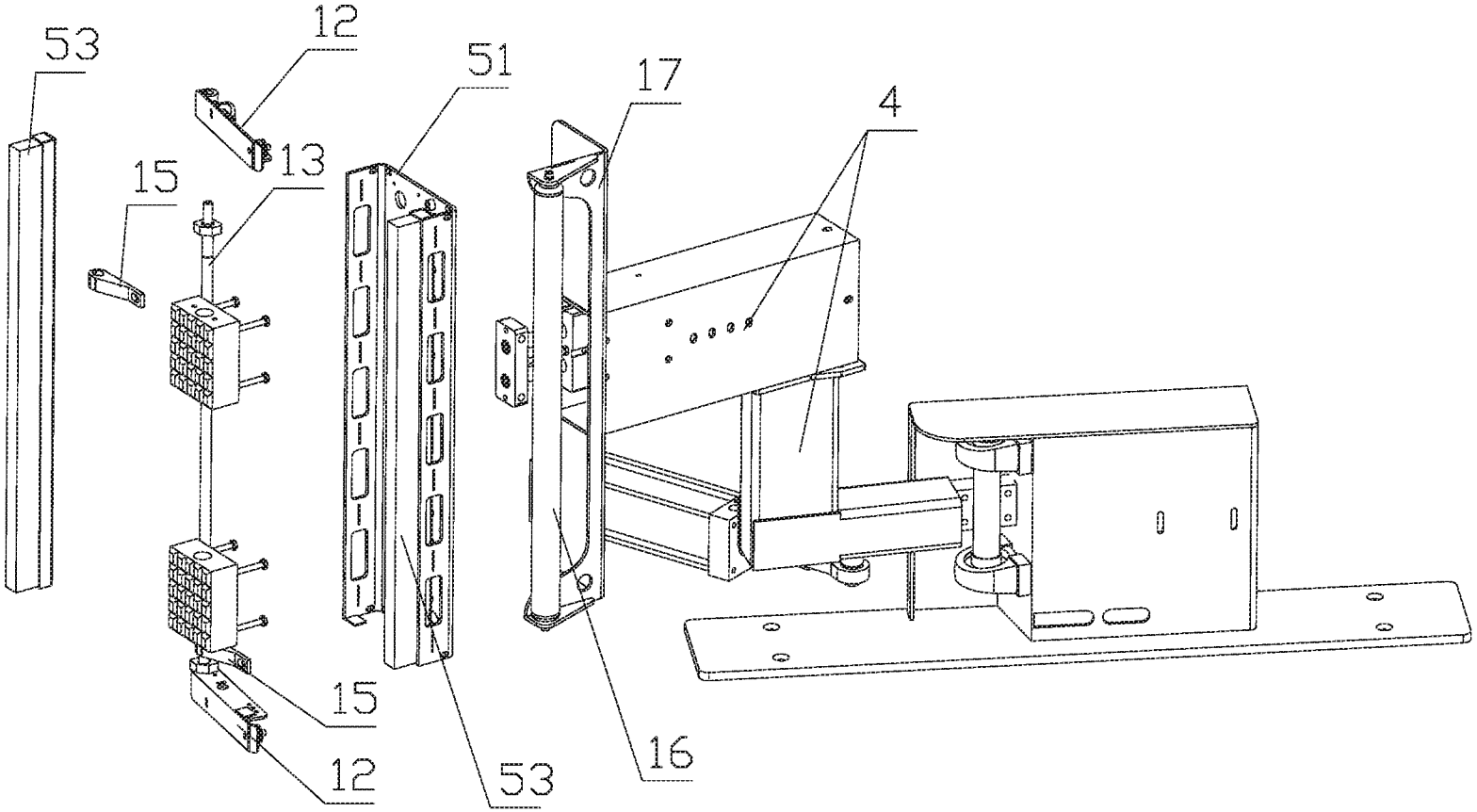
FIG. 11 is an exploded view of an automatic film cutting device according to an embodiment of the present invention.

The M-shaped winding machine is further provided with a storage battery charging connection device including a turntable upper part 610 and a turntable outer part 620, the turntable outer part 620 is mounted on the M-shaped turntable 200, the turntable outer part 620 is mounted on the base 100 next to the M-shaped turntable 200. When the M-shaped turntable 200 turns to the angle of a charging position (FIG. 3), the turntable upper part and the turntable outer part can be electrically connected. Preferably, the above angle of a charging position is the angle of the original position.

The turntable outer part 620 is provided with a driving cylinder 621 and a connecting contact 622. The driving cylinder 621 drives the connecting contact 622 to move forward and backward to the contact member 611 on the turntable upper part 610. The working of driving cylinder 621 is controlled by the main controller; In addition to cylinder drive, it can also be driven by an electric motor and controlled by the main controller. The turntable outer part 320 is connected with the power source, and the turntable upper part 610 transmits electricity to the storage battery 202 for charging. The turntable upper part 610 can be provided with positioning screws for aligning and positioning the contact member 611.

When the sensor detects that the M-shaped turntable 200 is turned to the angle of a charge position (FIG. 3), the main controller controls the driving cylinder 621 to work and drive the connecting contact 622 to move towards the contact member 611 on the turntable upper part 610, and when they can be electrically connected, the electricity is transmitted to the storage battery 502 for charging; when the M-shaped turntable 200 needs to be started, the main controller controls the driving cylinder 621 to work, and drives the connecting contact 622 to move away from the contact member 611 on the turntable upper part 610 and disconnect them.

The first driving electric motor and the driving electric motor of M-shaped turntable are also connected with the main controller and controlled by it.

The M-shaped winding machine is provided with a film lifting device 700, which is disposed on the base at the front of the film clamping device. The film clamping device is provided with a film lifting member 701 that can be lifted up and down in the space between the lifting film frame and the M-shaped turntable; the driving electric motor or cylinder 702 that drives the lifting of the film lifting member is controlled by the main controller, and the film lifting member 701 can be in a rod shape or a shape that the film can be rubbed from the bottom to up. The figure note 703 is a connecting piece between the film lifting member 701 and the cylinder 702; The M-shaped winding machine is provided with an automatic film cutting device 800, which is disposed at the base in front of the film clamping device and next to the film lifting device. The power device of the automatic film cutting device, e.g. the cylinder (cylinder 3, cylinder 41) having a driving action, is controlled by the main controller; and if it is driven by an electric motor, the electric motor can be controlled by the main controller.

After winding of the packaging film and before cutting, the film lifting member 70 can draw the packaging film from bottom to the up, so that it produces fold and shortens its transverse length, the cutting length can be less than the length of the film cutting machine and the packaging film can be completely cut off by the cutting machine mechanism, and the winding machine can work normally after film cutting to improve the winding quality of the packaging film. After cut, the packaging film can be hot stricked to the wrapped packaging film by the hot sticking mechanism, to ensure that the packaging film can be wound on the articles reliably and persistently, to improve the quality of packaging.

Referring to the figures, the automatic film cutting device provided herein includes a film cutting component, which uses the heating wire 1, and the heating wire 1 is connected with an elastic component 10 and tensioned by the elastic component 10. The elastic component 10 may be of a tension spring, one end of which is secured to the connecting piece 11 and the other end is connected to the heating wire 1. The connecting piece 11 is insulated and both ends of the heating wire are then connected to the heating circuit.

The heating wire 1 is connected to the elastic component 10 after a fixed pulley 2 so that the heating wire is not blocked when automatically adjusted by the elastic member, and the periphery of the fixed pulley is insulated, for example, an insulator 20 is provided at the outside of the fixed pulley 2 and the fixed pulley shaft is an insulator, so that the fixed pulley is insulated from the other parts connected to it and no longer electrically conductive.

Further, the elastic component 10 is connected to a swing mechanism, that is, the part that fixes the elastic component (connecting piece 11) is a part of the swing mechanism, to further provide cushioning for film cutting. The swing mechanism further includes a pendular mounting bracket 12, the connecting piece 11 is mounted on the mounting bracket 12. The fixed pulley 2 is connected to the mounting bracket 12, and the rotary shaft 13 of the swing mechanism is a vertical shaft, the swing mechanism is further connected to a supporting elastic member 14 which acts on the connecting piece 15 connected to the rotary shaft 13 to tighten the swing mechanism outside and provide cushioning when film cutting of the heating wire.

The automatic film cutting device provided in the invention further includes a hot sticking mechanism, which is driven to move by the driving device; after the winding and cutting, the tail part of the packaging film is hot sticked to wrapped packaging film; the driving device includes a cylinder 3, and the hot sticking mechanism is driven to move forward and backward by the cylinder 3 which is connected to the rotary mechanism 4. The rotary mechanism 4 is driven to rotate by the cylinder 41, and the rotating shaft 42 of the rotary mechanism 4 is a perpendicular shaft. The rotary mechanism 4 makes the hot sticking mechanism to rotate properly, and move forwards by the cylinder 3 for hot sticking.

The film cutting element is on a hot sticking mechanism and moves with the hot sticking mechanism so as to perform hot sticking after film cutting, improving the efficiency and reducing the power mechanism. In the present embodiment, in particular, the swing mechanism of the film cutting element is mounted on the mounting plate 51 of the hot sticking mechanism through which the film cutting element is placed on the hot sticking mechanism. The film cutting component is located outside the hot sticking mechanism, and the film cutting hot sticking device is provided with a vertical roller 16 on the rear side of the film cutting component; the elastic component 10 is at the upper, lower or upper and lower ends of the hot sticking mechanism. The reference note 17 is a roller mounting bracket, which is mounted on the rotary mechanism 4, and the roller 16 functions as a transition.

A flexible component 53 is provided beside the hot sticking component 52 of the hot sticking mechanism. When the hot sticking component 52 is at the original position before driven forwards by the cylinder 3, the front end of the flexible component 53 exceeds the front end of the hot sticking component 52. The flexible component 53 can be provided at one side or both sides of the hot sticking component 52, playing a role of flattening and anti-shift of the packaging film next to the hot sticking site and improving the hot sticking effect.

The hot sticking mechanism is provided with a number of hot sticking components from top to bottom. There is spacing between the upper and lower hot sticking components, to save the hot sticking components and expand the range of hot sticking.

The location of the rotary mechanism 4 is such that the lifting film frame 301 of the winding machine is located at the left and right sides of the upright post 300 of the winding machine respectively.

In the invention, the powerful M-shaped winding machine can save the transport space and facilitate the transport. The upright post is on the side at the back of the base (the right side at the back of the base in FIG. 1), which is in the same direction as the side where the film frame is on the upright post (the film frame is on the right side of the upright post in FIG. 1); a movable mounting plate 101 is provided at the back of the base, and the movable mounting plate 101 can be mounted on the base transversely through fasteners which can be bolts or pins, etc. The automatic film cutting device 800 is mounted on the movable mounting plate 101 which forms a notch 103 shape, and the upright post 300 is located at the notch. The movable mounting plate 101 is capable of removing a distance from the other side of the rear of the base (to the left side of FIG. 1, i.e., the reverse direction of notch) after releasing or removing the fastener, which can make the automatic film cutting device away from the upright post. In this way, when the connection way hinged by upright post and base is used and it is required to transport, the automatic film cutting device is moved to another side at the rear of the base, and then fixed by fasteners; the film lifting device is easy to assemble and disassemble; therefore, the upright post can be rotated and put down, greatly saving the transport space and facilitating transport. During installation, after the upright post is rotated to erect, the rotating part is fixed with a fastener, then the fastener is released or removed again to reset the moving module formed by the movable mounting plate 101 and the automatic film cutting device 800 by reversely moving, and then fixed by fasteners, to achieve quick and convenient installation. In addition, this structure can fine-tune the installation position of the automatic film cutting device.

When the removable movable plate 101 is fixed by screws, its screw fixing hole 102 may be an long hole adjusted along the left and right direction, and the length of the long hole can make the transverse automatic film cutting device to avoid the upright post after transverse movement and adjustment.

What is claimed is:

1. An M-shaped winding machine, provided with a base, a rotatable M-shaped turntable and an upright post, the upright post is provided with a film frame lifting device which is driven to work by a first electric motor, the film frame lifting device is at one side of the upright post; wherein, the M-shaped winding machine is provided with a main controller; the M-shaped winding machine is further provided with a film clamping device, the film clamping device is provided on the M-shaped turntable, is driven to work by a second electric motor and uses a storage battery as a power source; a secondary controller for controlling the second electric motor is also provided on the M-shaped turntable, is in a communication connection with the main controller via wireless data and is controlled by the main controller; a film clamping working position of the film clamping device is in front of the upright post when the M-shaped turntable turns to an angle of an original position; the M-shaped winding machine is also provided with a storage battery charging connection device comprising a turntable upper part and a turntable outer part, the turntable upper part is mounted on the M-shaped turntable and the M-shaped turntable is mounted on the base next to the M-shaped turntable, when the M-shaped turntable turns to an angle of a charging position, the turntable upper part and the turntable outer part of the storage battery charging connection device can be electrically connected, the turntable outer part is connected with the power source, and the turntable upper part transmits electricity to the storage battery for charging; the first electric motor of the M-shaped turntable is also connected with the main controller, and controlled by the main controller.

2. The M-shaped winding machine according to claim 1, wherein the turntable outer part is provided with a driving cylinder and a connecting contact, the driving cylinder drives the connecting contact to move front and back toward to a contact member of the turntable upper part, and the working of driving cylinder is controlled by the main controller.

3. The M-shaped winding machine according to claim 2, wherein the M-shaped winding machine is provided with the film frame lifting device, which is disposed at the base in front of the film clamping device, the film frame lifting device is provided with a film lifting member that can be lifted up and down, the film lifting member is lifted up and down in the space between a lifting film frame and the M-shaped turntable; the first electric motor or cylinder that drives the film lifting member to lift up and down is controlled by the main controller; the M-shaped winding machine is provided with an automatic film cutting device which is disposed at the base in front of the film clamping device, a power device in the automatic film cutting device is controlled by the main controller.

4. The M-shaped winding machine according to claim 3, wherein the upright post is on a side at the back of the base, which is in the same direction as the side where the film frame lifting device is on the upright post; a movable mounting plate is provided at the back of the base, and the movable mounting plate can mounted on the base transversely through fasteners, the automatic film cutting device is mounted on the movable mounting plate which forms a notch, and the upright post is located at the notch.

* * * * *